United States Patent [19]

Brown et al.

[11] 4,013,460

[45] Mar. 22, 1977

[54] PROCESS FOR PREPARING CEMENTED TUNGSTEN CARBIDE

[75] Inventors: Charles M. Brown; Harry J. Brown, both of Lewiston, N.Y.

[73] Assignee: Union Carbide Corporation, New York, N.Y.

[22] Filed: Sept. 6, 1973

[21] Appl. No.: 394,618

Related U.S. Application Data

[63] Continuation-in-part of Ser. No. 236,608, March 21, 1972, abandoned.

[52] U.S. Cl. ..... 75/204; 29/182.8; 75/211

[51] Int. Cl.[2] ..... B22H 1/04; C22C 1/05; C22C 29/00

[58] Field of Search ..... 75/203, 204, 211; 29/182.7, 182.8

[56] References Cited

UNITED STATES PATENTS

| | | | |
|---|---|---|---|
| 1,794,300 | 2/1931 | Kelley | 75/204 |
| 3,165,822 | 1/1965 | Beeghly | 29/182.8 X |
| 3,167,428 | 1/1965 | Globus | 75/204 |

*Primary Examiner*—Richard E. Schafer
*Attorney, Agent, or Firm*—Frederick J. McCarthy, Jr.

[57] ABSTRACT

The present invention is a process for making shaped, dense, hard, fine grain tool quality tungsten carbide by the interaction of tungsten, carbon and cobalt during a single heat treatment to form WC + Co compositions. The interaction occurs in situ without the aid of applied pressure. The interaction produces wares of high density with excellent mechanical and cutting properties.

4 Claims, 2 Drawing Figures

PROCESS FOR PREPARING CEMENTED TUNGSTEN CARBIDE

This application is a continuation-in-part of U.S. Application Ser. No. 236,608 filed Mar. 21, 1972 now abandoned.

The present invention relates to a process for making cemented tungsten carbide. More particularly, the present invention relates to a simplified process for interacting finely divided tungsten, cobalt and graphite to produce cemented tungsten carbide articles of high density and excellent mechanical and cutting properties.

In the past, the commercial manufacture of cemented tungsten carbide has involved the initial preparation of tungsten carbide, WC, by reacting tungsten and carbon, followed by crushing of the tungsten carbide and admixture thereof with cobalt. The WC, which is very hard and abrasive, was wet ball milled with the admixed cobalt. The resulting blended mixture, with the addition of a lubricant, required to reduce friction, was compacted and the compacts subsequently sintered. The resulting material was well suited for use as cutting tools however the extended processing required imposed a significant economic detriment. For example, since the crushing and milling of WC was required, costly wear-resistant equipment was necessitated. Also, the separate, initial formation of WC and the subsequent crushing required substantial additional processing time as did the requirement for elimination of the lubricant prior to sintering. Also, the green strength of the WC + Co compacts is not high thus requiring careful handling to avoid breaking and chipping.

It is therefore an object of the present invention to provide a simplified, efficient method for producing cemented tungsten carbide.

Figure 1:
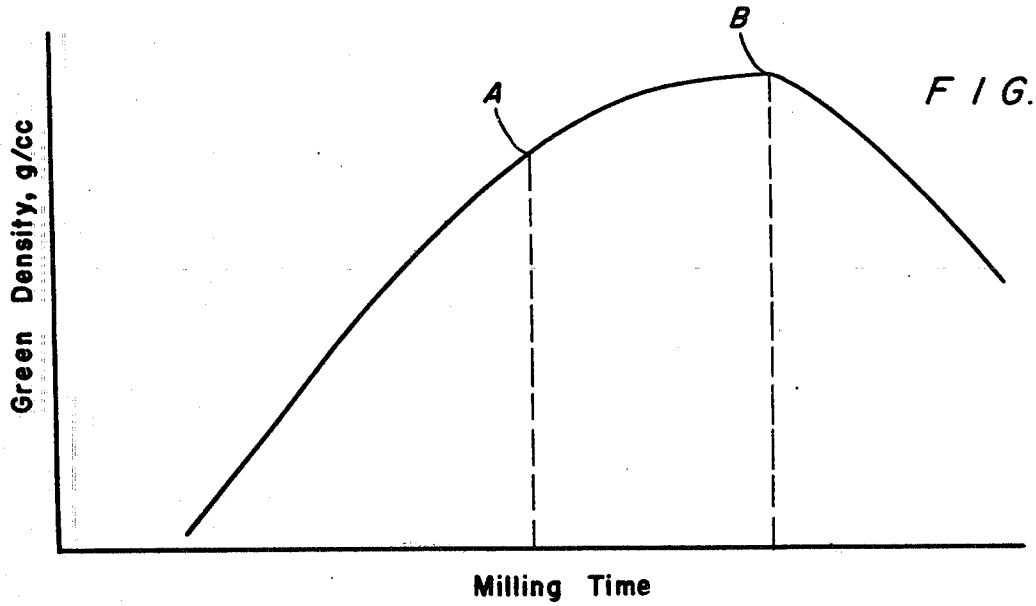
Figure 2:
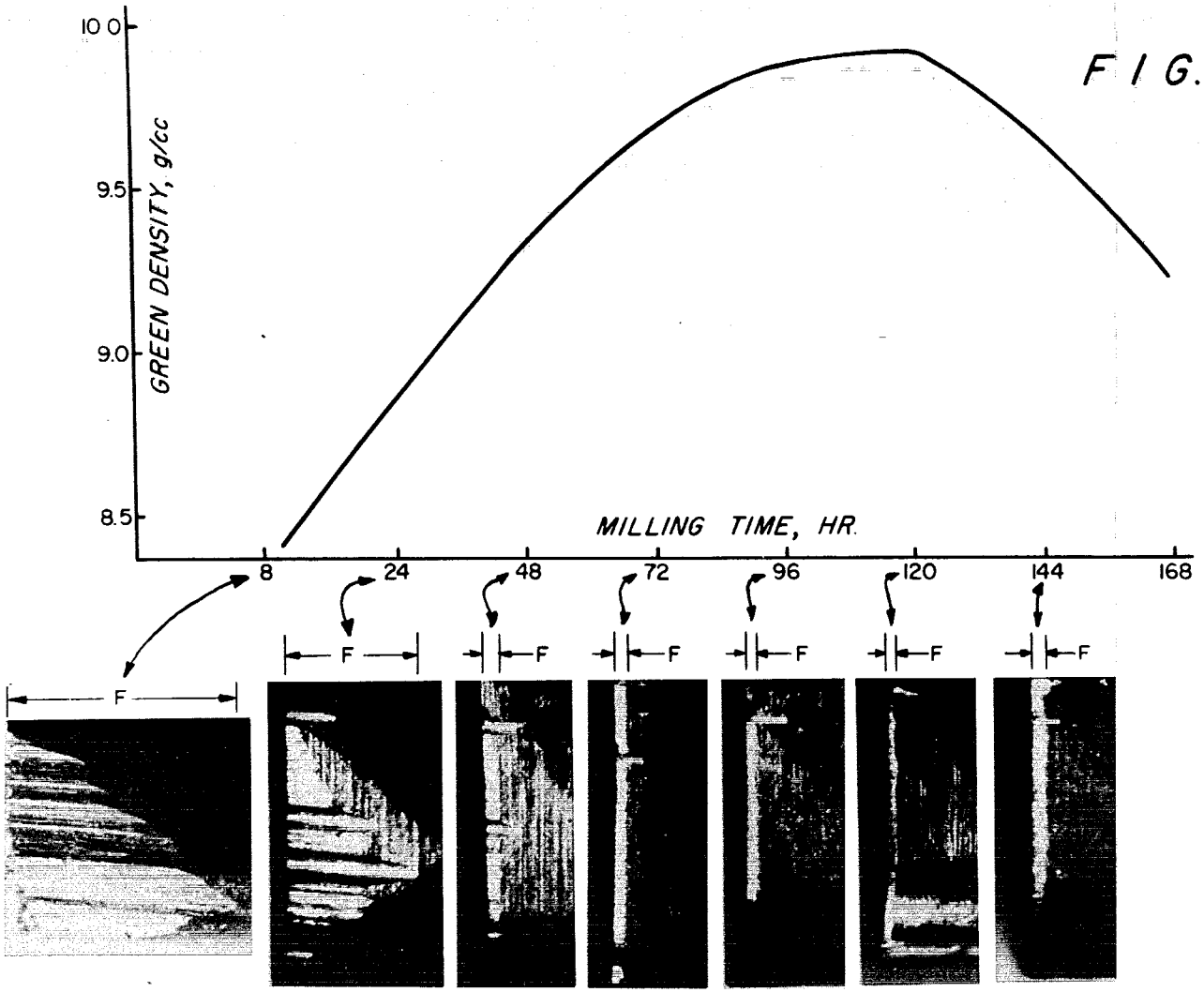

Other objects will be apparent from the following description and claims taken in conjunction with the drawing wherein FIG. 1 shows a graph illustrating the effect of milling time on the density of compacts cold pressed from representative mixtures of tungsten, cobalt and graphite and FIG. 2 shows specific values for a graph of the FIG. 1 type for a mixture of tungsten and graphite with 6% cobalt.

A method in accordance with the present invention comprises providing a mixture of finely divided elemental tungsten, elemental cobalt and graphite, the amounts of tungsten and graphite in the mixture being in substantially stoichiometric proportions for the production of WC and the amount of cobalt being from about 3 to 20% by weight of the mixture of tungsten, graphite and cobalt; ball milling the mixture of tungsten, cobalt and graphite for a time sufficient to provide substantially optimum density in green compacts cold pressed from said mixture; terminating the ball milling at such time and cold pressing the mixture into compacts; thereafter sintering the cold pressed compacts at an elevated temperature to cause substantially all of the tungsten and graphite to combine and form WC.

In the practice of the present invention, commercial grade elemental tungsten powder, such as UCAR tungsten powder (available from Union Carbide Corporation) is mixed with elemental cobalt powder (available from African Metals Corporation) together with graphite.

The sizing of the starting mixture constituents is important and it has been found that an average particle sizing of 2 to 2 ½ microns for the tungsten and 1 to 1 ½ microns cobalt, and a graphite sizing of 200 mesh and finer provides the best results as regards processing efficiency and product properties. A range of 1–3 microns average particle size for the tungsten and cobalt provides excellent results. Finer sizing for the tungsten and cobalt can be used but becomes impractical at about 0.5 microns due to the possibility of pyrophoricity and the expense and inconvenience involved in obtaining such fine sizes. Larger sizing is undesirable since very extended milling times are required and the difficulty of eliminating porosity in the sintered product.

The proportion of graphite with respect to tungsten in the mixture should be substantially the atoichiometric amount required to form WC upon complete reaction of the tungsten and graphite. As a practical matter the graphite can vary about ±0.1% by weight from the stoichiometric amount. At lower amounts of graphite an undesirable brittle $W_2C$ phase is formed in the sintered article, whereas at higher amounts finely dispersed free carbon remains in the microstructure. Both of these conditions are undesirable from the standpoint of obtaining optimum transverse strength and cutting properties.

The amount of cobalt in the mixture which can range from 3 to 20%, is the usual range for commercial cemented tungsten carbide.

When the desired mixture of tungsten, cobalt and graphite is prepared it is subjected to ball milling to provide blending and an optimization of product properties as hereinafter more fully described. Either rotary ball milling or vibratory ball milling can be used.

The ball milling is suitably accomplished using a conventional ball mill such as a stainless steel mill which employs ½ to ¾ diameter steel or tungsten balls as the milling media.

The milling time of the mixture is a critical feature of the present invention. If the mixture is not milled long enough (under milled) or milled too long (over milled) optimization of properties in the product is not obtained and in fact serious defects in the product can result. When the milling time is appropriately limited, optimum values are obtained for green density, green strength, sintered density, linear shrinkage during sintering, porosity, grain size, hardness, strength and cutting tool performance.

The appropriate milling time for a given mixture of tungsten, cobalt and graphite can be determined in the following manner. The mixture is charged to a ball mill and the milling commenced. At regular intervals, for example every twenty four hours or less, a sample of the mixture is removed from the mill and cold pressed into a compact, e.g. at 31,200 ± 500 psi in a double acting die and the green density of the compact measured. The densities obtained can be plotted as a graph against milling time as illustrated in FIG. 1. When optimization of density is indicated, i.e. in the time range of A–B, the critical milling time is established for the particular mixture and amount being milled. The density at A, for example, is at least 96% of the maximum density indicated at B; at B, the optimum green density is initially achieved, i.e. the slope of the graph has become essentially zero. The critical milling time range thus obtained can be applied to any mixture corresponding to the mixture from which the samples were taken, for the particular amount being milled. If a subsequent charge to the mill is increased in amount, the critical milling time will be decreased and vice versa. Also, if the cobalt content is increased, the critical milling time increases and vice versa. As a preferred practice, ball milling is continued until the green density is at least 96% of the maximum, where the slope of the curve begins to approach zero, and then discontinued.

The generally symetrical shape of the curve of FIG. 1 is characteristic for a typical ball milled mixture with which the present invention is concerned and the critical milling time for any particular mixture, or any amount, can be readily determined in the aforedescribed manner, i.e. by determining optimization of green density. With some tungsten, cobalt, graphite mixtures, the graph of FIG. 1 may approach the dashed line configuration illustrated in FIG. 1. This however does not affect the determination of the appropriate milling time as previously described. Also, continued milling after the initial optimization of green density at times can lead to a second "optimization" of density at a value higher than the initial optimization. In this case also, it is the initial optimization that determines the critical milling time, since subsequent milling thereto leads to generally inferior and unpredictable results in the final sintered product. When the appropriate milling time has been established, the mixture milled for this time is cold compacted, for example at pressures of 16,000 to 40,000 psi into the desired shapes. The preferred compacting pressure is 31,200 ± 500 psi. No lubricant is required and the use of graphite as the carbon constituent has been found to result in strong green shapes which can be readily handled without chipping or breaking and can be pre-machined if desired.

The following data of Table I shows an advantage of using graphite as compared to the customarily used carbon black (thermotomic carbon). The samples tested were pressed at 31,200 psi in ½ wide × 1 ⅛ inches long dies. The initial sizing of the tungsten was 2.5 microns; the initial sizing of the cobalt was 1.31 microns. The sizing of the thermatomic carbon was submicron and the graphite was finer than 200 mesh. The milling time for both mixtures was 100 hours.

TABLE I

| | Transverse Green Strength |
|---|---|
| W + Carbon + 10% Co | 157 psi |
| W + Graphite + 10% Co | 2000 psi |

After forming, the cold compacted green shapes are subjected to sintering either under vacuum (e.g. 0.1 to 1 $\mu$) or in a hydrogen atmosphere at elevated temperatures in the range of 1350° to 1550° C for a period of from 1 to 2 hours. Prior to the actual sintering step it is advantageous to heat the compacts for about ½ hour in a hydrogen atmosphere or under vacuum to eliminate any moisture. Following this drying step and before the actual sintering, the compacts can be heated at 900°–1200° C for about ½ hour so that any minor amounts of W and Co oxides can be expelled from the compacts. The final sintering can be performed under a hydrogen or vacuum atmosphere at a temperature in the range of 1350° to 1550° C as above mentioned. With different amounts of cobalt, different sintering temperatures are recommended to obtain a fine grained product. With a cobalt content of 20% an appropriate temperature is 1350° C; for Co contents of 6–10%, 1400° C is satisfactory and at 3% Co a temperature of 1450–1500° C is advantageously employed. With additions of TiC, TaC, VC, CbC and $Cr_2C_3$ temperatures in the range of 1500°–1550° C are recommended. Individual additions of the foregoing materials can be made in amounts of up to 10% by weight. When more than one of the foregoing materials is added, the aggregate amount of the addition can be up to 20%. The foregoing additions can be made as such or in combination with WC, e.g. a solid solution of TiC and WC. In such a case the WG is not counted in calculating the percentage amount of the addition.

As mentioned above, sintering times of 1–2 hours have been found suitable, however, any sintering time and temperature relationship which results in the substantially complete combination of the tungsten and graphite to form WC is within the scope of the present invention. That is to say, as a result of the sintering step, at least 99.9% of the total tungsten plus carbon in the final sintered object should be in the form of WC.

The following example will further illustrate the method of the present invention.

EXAMPLE I

A mixture of elemental tungsten, elemental cobalt and graphite was prepared. The tungsten was UCAR tungsten powder from Union Carbide Corporation having an average particle size of 2.5 microns; the cobalt powder was extra fine grade from African Metals Corporation having an average particle size of 1.31 microns, the graphite was Acheson No. 38 powder (available from Union Carbide Corporation), sized 200 mesh and finer. The proportions were such as to produce a final WC product containing 6% Co. The amounts of W, Co and graphite in the mixture were as follows:

| | | |
|---|---|---|
| W | 1762.5 | Grams |
| Co | 120.0 | " |
| Graphite | 117.5 | " |

The tungsten, cobalt and graphite constituents were charged to a stainless steel ball-mill 5 ¾ inches high having an inner diameter of 6 inches. The milling media was 6000 grams of steel ½ inch diameter balls. The mill was turned at 76 RPM. At the milling times indicated in Table A samples were taken from the mixture and pressed at 31,200 psi in dies to form green compacts. The test specimens were prepared in a die of the type described in MPIF Standard 13–62. The dimensions were changed to conform to the ASTM Standard sized specimen for cemented tungsten carbide transverse rupture tests. The rupture test specimen dimensions after finish grinding are 0.200 ± 0.010 × 0.250 ± 0.010 × minimum length of 0.750 inch long. The density of the green compacts was measured and compacts were then packed in a grog in graphite boats and furnaced in pure hydrogen in a molybdenum wound push-through sintering furnace. The grog was composed of 25% by weight granular graphite and 75% by weight granular $Al_2O_3$, both sized from 48 to 100 mesh. The boats were introduced into a 200 ° C zone and held there for ½ hour to eliminate air and moisture. The boats were then advanced into a 900°–1100° C zone and held there for ½ hour to cause reduction of incidental metal oxides. After this treatment the boats were advanced into a 1400° C zone and held for 1 ½ hours. After the final heat treatment the sintered samples were cooled to room temperature in a water cooled chamber in about 12 minutes. In all of the samples the tungsten was combined 100% as WC.

In addition to the above-described samples, cutting tool inserts were also prepared for each milling time using the procedure described above. A die with a square cavity was prepared for producing inserts having a final ground dimension of 0.50 × 0.50 × 0.1875 in. thick. No lubricant was used and the specimens were pressed at 31,200 psi.

The samples and inserts were tested and the results are shown in Table A. The porosity rating was measured in accordance with ASTM B 276-54, the grain size was measured in accordance with the same standard and the tool life tests were conducted in accordance with J. Taylor, "Tool Wear Time Relationship in Metal Cutting", International Journal Machine Tool Design Research, 119, 1962.

The values of green compact density of Table A above are plotted vs. milling time in FIG. 2 of the drawing. From FIG. 2 of the drawing it can be seen that the milling period from 72 to 120 hours is within the critical milling time. The green density is optimized in this range and the data of Table A shows that the properties of the samples and cutting tool inserts are optimum in this range. FIG. 2 also shows at 30X the flank wear (indicated as F) on tool inserts made from mixtures milled for the indicated times. The photographs show decreased flank wear for milling times in the period of 72 to 120 hours.

From the foregoing data of Example I it can be seen that sintered products made from mixtures milled for the critical period have optimized and enhanced properties. For example, the linear shrinkage for Test specimens 4, 5 and 6 are substantially less than for other milling times thus enabling the closer control of final part dimensions. Also, the porosity rating is optimized in Test specimens 4, 5 and 6 which ensures excellent cutting properties. In addition, a grain size of 1–3 is obtained for Test specimens 4, 5 and 6 thus further ensuring excellent cutting tool properties. In addition, hardness, strength and "Tool Life" are shown to be optimized for Test specimens 4, 5 and 6. The cutting tool properties for Test specimens 4, 5 and 6 are at least as good as those obtained with leading commercial cutting materials such as Carboloy 883*.

* Trademark of General Electric

In addition to cobalt, the products produced by the process of the present invention can contain additions of materials such as TiC, TaC, VC, Cbc and $Cr_2C_3$ as previously described. These materials are added to the tungsten, graphite, cobalt mixture prior to milling and suitably have an initial particle sizing of from 0.1 to 5 microns.

The following examples further illustrate the present invention:

EXAMPLE II

A mixture was prepared from the materials of Example I except that the proportions were chosen to provide a 3% cobalt content in the final sintered product. The amounts of W, Co and graphite in the mixture were as follows:

| | | |
|---|---|---|
| W | 1818.75 | grams |
| Co | 60.0 | " |
| Graphite | 121.5 | " |

The mixture was processed in the manner described in Example I except that the final heat treatment was at 1500° C; samples were taken at the intervals shown in Table B. As can be seen from Table B the milling period of 58 to 112 hours is within the critical milling time.

EXAMPLE III

A mixture was prepared from the materials of Example I except that the proportions were chosen to provide a 10% cobalt content in the final sintered product. The amounts of W, Co and graphite in the mixture were as follows:

| | | |
|---|---|---|
| W | 1687.5 | grams |
| Co | 200.0 | " |
| Graphite | 112.50 | " |

The mixture was processed in the manner described in Example I and samples were taken at the intervals shown in Table C. As can be seen from Table C the milling period of 65 to 128 hours is within the critical milling time.

EXAMPLE IV

A mixture was prepared from the materials of Example I except that the proportions were chosen to provide a 20% cobalt content in the final sintered product. The amounts of W, Co and graphite in the mixture were as follows:

| | | |
|---|---|---|
| W | 1031.25 | grams |
| Graphite | 68.75 | " |
| Co | 275.0 | " |

The mixture was milled for 60 hours and after compacting, was sintered in hydrogen for 1 hour at 1350° C. The properties of sintered articles made from the mixture are shown in the Table below:

| Density, g/cc Green | Density, g/cc Sintered | Hardness $R_A$ | A.S.T.M. Porosity Rating | A.S.T.M. Grain Size | Transverse Strength, psi |
|---|---|---|---|---|---|
| 8.64 | 13.30 | 86.6 | A-1,C-5 | 1–5 | 305,000 |

Several tests indicating resistance to mechanical shock were made on cutters made from the W+G+20Co mix. The test involved lathe turning of bars* having either two or four slots cut parallel to the axis. The peripheral speed of the bar was maintained at 90–95 ft./min. and the time for the cutter to fail was measured. The results were as follows:

* The bars were made of Firmex alloy tool steel available from the International Alloy Tool Steel Company.

| Average Survival Times, Seconds | | | |
|---|---|---|---|
| Feed 0.010"/Rev. Depth, 0.050" | | Feed 0.0203"/Rev. Depth, 0.030" | |
| 2 Slot | 4 Slot | 2 Slot | 4 Slot |
| 137.0 | 52.0 | 151.0 | 171.5 |

EXAMPLE V

A mixture was prepared from the materials of Example I with the addition of TaC and TiC to provide a final sintered product containing 4.5% TiC, 4.3% TaC and 8.8% Co. The amounts of the ingredients in the mixture were as follows:

| | | |
|---|---|---|
| W | 852.80 | grams |
| Graphite | 56.85 | " |
| Co | 107.80 | " |
| TaC (Sized 2 ½ microns) | 52.68 | " |
| TiC-WC (50/50 alloy sized 2 microns) | 154.85 | " |

The mixture was milled for 88 hours and the sintering was done under a hydrogen atmosphere at 1500° C for 1 hour.

The properties of the sintered articles made from the mixture are shown in the Table below:

| | |
|---|---|
| Green density | 9.07 g/cc |
| Sintered density | 12.77 |
| Linear Shrinkage | 10.07% |
| ASTM Porosity Rating | A-1 |
| ASTM Grain size | 1–2 |
| Hardness | 91.5 $R_A$ |
| Transverse Strength | 140,700 psi |

A particular advantage of the process of the present invention is the substantially shorter processing time required. Current commercial practices which involve the initial formation of WC, followed by crushing and mixing with cobalt require on the order of five weeks from raw materials to sintered final product whereas the process of the present invention requires only three weeks. Also, the linear shrinkage during sintering in the present process is 40% less than that which occurs during the aforementioned prior process thus enabling closer dimensional control.

The above-described process of the present invention makes unnecessary the intermediate steps formerly used of first preparing, and then grinding and pressing hard and abrasive WC. This means that with the present process, wear on mills, milling media and pressing dies will be considerably reduced, and these parts will have extended lives. Also, because of the reduced number of processing steps in the new process, the total time required for processing raw materials to final parts is reduced by nearly half.

The process of the present invention provides green pressed pieces with more than a 10-fold increase in strength compared with the conventional process as shown in Table I. It has been found that such parts are sufficiently strong that a considerable amount of machining to special shapes can be done before sintering. Heretofore, in the conventional process, a special sintering treatment was required to provide enough strength for machining. Cutting of the green pressed material in accordance with the present invention is also much easier than cutting sintered WC as has been previously required.

Another advantage of the present invention is that aspect of the very high green strength of the new process powders is that the high green strength is obtained without the use of temporary binders as in the conventional prior art process. The conventional temporary binders are usually stearate compounds or paraffin. When such materials are used during the sintering step, additional time is required at a low temperature so that these compounds can escape. This added time is unnecessary in the process of the present invention.

The following Example VI illustrates the use of the method of the present invention is producing granules which are highly suitable for use in hardfacing operations wherein an essentially tungsten carbide surface is applied to a metal substrate.

EXAMPLE VI

A mixture of elemental tungsten, elemental cobalt and graphite was prepared. The tungsten was UCAR tungsten powder from Union Carbide Corporation having an average particle size of 2.0 microns; the cobalt powder was extra fine grade from African Metals Corporation having an average particle size of 1.31 microns, the graphite was Acheson G-39 powder (available from Union Carbide Corporation), sized 200 mesh and finer. The proportions were such as to produce a final WC product containing 6% Co. The amounts of W, Co and graphite in the mixture were as follows:

| | | |
|---|---|---|
| W | 9,993.4 | Grams |
| Co | 680.4 | " |
| Graphite | 666.2 | " |

The tungsten, cobalt and graphite constituents were charged to a stainless steel ball-mill 9½ inches high having an inner diameter of 12½ inches. The milling media was 75 lbs of steel ½ inch diameter balls. The mill was turned at 52 RPM and the milling time was 60 hours to provide optimized green density. Samples were taken from the milled mixture and pressed at 31,200 psi in dies to form green compacts. The test specimens were prepared as in Example I. The density of the green compacts was measured and found to be 10.00 gms/cc. The milled powder was roll compacted to sheet at 2000 psi load on 3 inch diameter rolls with a feed cheek spacing of one inch. The green density of the rolled sheet averaged 10.0 gms/cc. The sheet was crushed and sized to 20 × 80 mesh granules. The granules were placed in graphite boats and sintered under the same conditions as Example I. The sintered bulk density of the granules was 124.8 gms/cu inch. The ASTM porosity rating of a polished section of a sintered sample was A-1.

The shape of the granules can be controlled to produce chunky particles or platelets by controlling the thickness of the rolled sheet. The diameter of the rolls determines the angle of nip. For example, a set of 18 inch diameter rolls will provide ⅛ – 3/16 inch thick green plate while 3 inch diameter rolls yield approximately 0.031 inch thick sheet. Very large granules can be made by pressing larger sized compacts and subsequently crushing to the desired size.

Tungsten carbide material produced in accordance with the present invention in the form of granules as illustrated in Example VI is used for conventional hard-facing applications. The material is deposited by either acetylene or arc welding techniques. The granules are generally encapsulated into a mild steel casing and applied as either wire or rod. The granules constitute about 40–50 weight percent of the filled rod. Application of the hard-facing deposit with an oxyacetylene requires a torch tip larger than normally used for mild steel rod. The flame should have an excess acetylene adjustment so that the feather is about four times the length of the inner cone. At the starting point of the deposit, the base plate is heated to sweating temperature and the rod is applied to the required width and thickness with a minimum of penetration. The rod casing bonds the granules to the surface of the base plate. Electric application is by two basic techniques. (*a*) The filler rod is used as the electrode with the rod casing melting and bonding the granules to the surface being coated. (*b*) A nonconsumable electrode is used to melt a puddle in the base plate and granules are fed into the molten pool.

The granules prepared in accordance with the present invention are hard and refractory and are dense and do not dissolve or melt excessively in the molten iron matrix during deposition. It is important that the granules be dense because porosity increases the surface area and results in greater dissolution of the granules and dissolved WC, upon cooling is precipitated out of solution as $M_6C$ and is not so wear resistant as the cast carbide granules. If the porosity is too great the complete granule may dissolve.

The mesh sizes referred to herein are United States Series.

TABLE A

| Milling Hr. | Green Density, g/cc | Linear % Shrinkage | Sintered Density, g/cc | ASTM Porosity Rating | Grain Size | Hardness $R_A$ | Strength KPSI | Tool Life Straight Turning Tests** Surface 430 | | Ft./Min. 500 | |
|---|---|---|---|---|---|---|---|---|---|---|---|
| 8 | 8.47 | 12.6 | 13.36 | A-4 B-6 | 1–5 | 84.0 | 169.4 | 0.1 | min. | 0.1 | min. |
| 24 | 8.76 | 14.0 | 14.32 | B-5 | 1–3 | 89.2 | 166.0 | 7.5 | " | 1.5 | " |
| 48 | 9.45 | 13.2 | 14.83 | A-2 B-4 | 1–3 | 91.0 | 244.7 | 60.0 | " | 4.3 | " |
| 72 | 9.82 | 12.0 | 14.98 | A-1 B-2 | 1–3 | 92.8 | 219.5 | 75.0 | " | 7.5 | " |
| 96 | 10.01 | 11.7 | 15.01 | A-1 | 1–3 | 92.0 | 225.9 | 100.0 | " | 10.0 | " |
| 120 | 10.03 | 11.4 | 14.99 | A-1 | 1–3 | 92.2 | 213.9 | 75.0 | " | 12.0 | " |
| 144* | 9.66 | 12.5 | 15.22 | A-1 B-1 | 1–3 | 92.2 | 224.2 | 60.0 | " | 10.0 | " |

*Laminated on pressing
**304 Stainless steel SECA 45° Neg. 7° Feed 0.008 in./rev. Depth 0.040 in.

TABLE B

| No. | Milling Hour | Green Density, g/cc | Linear % Shrinkage | Sintered Density, g/cc | ASTM Porosity Rating | Grain Size | Hardness $R_A$ | Strength KPSI |
|---|---|---|---|---|---|---|---|---|
| 1 | 1 | 8.67 | | | | | | |
| 2 | 24 | 9.40 | | | | | | |
| 3 | 46.5 | 9.79 | | 15.12 | | | 91.0 | 270 |
| 4 | 58 | 10.12 | 12.07 | 15.20 | A-4, B-1 | 2–5 | 92.0 | 223 |
| 5 | 72 | 10.32 | 11.55 | 15.29 | A-2 | | 91.8 | 286 |
| 6 | 65 | 10.20 | 11.78 | 15.24 | | | 92.2 | 245 |
| 7 | 88 | 10.49 | 11.23 | 15.30 | A-1 | 2–5 | | 280 |
| 8 | 112 | 10.65 | 10.97 | 15.19 | | | 89.5 | |
| 9 | 128 | 10.61 | 10.96 | 15.11 | | | 91.0 | |
| 10 | 160 | 10.61 | 11.03 | 15.05 | A-3, C-1 | 2–5 | 91.5 | 209 |
| 11 | 192 | 10.66 | 10.82 | | A-4, C-1 | | 92.0 | 203 |

TABLE C

| No. | Milling Hour | Green Density, g/cc | Linear % Shrinkage | Sintered Density, g/cc | ASTM Porosity Rating | Grain Size | Hardness $R_A$ | Strength KPSI |
|---|---|---|---|---|---|---|---|---|
| 1 | 26 | 8.88 | | | | | | |
| 2 | 58 | 9.41 | 11.92 | 14.51 | A-4, C-4 | 1–3 | | |
| 3 | 65 | 9.52 | 11.68 | 14.53 | | 1–3 | 91.2 | 303 |
| 4 | 80 | 9.62 | 11.13 | 14.57 | | 1–4 | | |
| 5 | 88 | 9.65 | 10.98 | 14.55 | A-2, C-4 | 1–4 | 90.2 | 357 |
| 6 | 100 | 9.76 | | 14.41 | | | 90.8 | 274 |
| 7 | 128 | 9.81 | 11.15 | 14.37 | A-2,B-1,C-1 | | 91.2 | 235 |
| 8 | 144 | 9.81 | 11.25 | 14.37 | | | 90.8 | 253 |
| 9 | 176 | 9.89 | 11.04 | 14.39 | | | 90.8 | 194 |
| 10 | 208 | 9.86 | 10.54 | 14.34 | A-1,C-1 | 1–4 | 91.0 | 207 |

What is claimed is:

1. A method for producing cemented tungsten carbide compositions which comprises i. providing a mixture of finely divided elemental tungsten, elemental cobalt and graphite, the amounts of tungsten and graphite in the mixture being in substantially stoichiometric proportions for the production of WC and the amount of cobalt being from about 3 to 20% by weight of the mixture of tungsten, graphite and cobalt, ii. ball milling the mixture of tungsten, cobalt and graphite, said ball milling being only for a time until at least about 96 percent of optimum density is first provided in green compacts cold pressed from said mixture, iii. terminating the ball milling at such time and cold pressing the mixture into compacts, iv. sintering the cold pressed compacts at an elevated temperature in the range of about 1350° to 1550° C to cause substantially all of the tungsten and graphite to combine and form WC.

2. A method in accordance with claim 1 wherein the average particle size of the tungsten is 2 to 2.5 microns, the cobalt is to 1 to 3 microns and the graphite is sized finer than 200 mesh.

3. A method in accordance with claim 1 wherein the cold pressing of step (iii) is accomplished at a pressure in the range of 10,000 to 40,000 psi.

4. A method in accordance with claim 1 wherein at least one material selected from the group consisting of TaC, TiC, $Cr_3C_2$, VC, and CbC is included in the mixture of tungsten, cobalt and graphite in an amount of up to about 10% where a single selected material is included in the mixture and up to 20% where more than one selected material is included in the mixture.

* * * * *

UNITED STATES PATENT OFFICE

CERTIFICATE OF CORRECTION

Patent No. 4,013,460 Dated March 22, 1977

Inventor(s) Charles M. Brown et al.

It is certified that error appears in the above-identified patent and that said Letters Patent are hereby corrected as shown below:

Column 2, line 17 "atoichiometric" should read --stoichiometric--.

Column 4, line 13 "WG" should read --WC--.

Column 3, line 39 "thermotomic" should read--thermatomic--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*